US009865388B2

(12) United States Patent
Ishida et al.

(10) Patent No.: US 9,865,388 B2
(45) Date of Patent: Jan. 9, 2018

(54) ELECTRONIC COMPONENT AND COMMON MODE CHOKE COIL

(71) Applicant: MURATA MANUFACTURING CO., LTD., Kyoto-fu (JP)

(72) Inventors: Kosuke Ishida, Nagaokakyo (JP); Sayaka Sekiguchi, Nagaokakyo (JP); Masaki Kitajima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/052,296

(22) Filed: Feb. 24, 2016

(65) Prior Publication Data

US 2016/0172100 A1 Jun. 16, 2016

Related U.S. Application Data

(63) Continuation of application No. PCT/JP2014/072242, filed on Aug. 26, 2014.

(30) Foreign Application Priority Data

Sep. 2, 2013 (JP) ..... 2013-181013

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 27/245*** | (2006.01) |
| ***H01F 27/29*** | (2006.01) |

(52) U.S. Cl.

CPC ..... *H01F 27/2804* (2013.01); *H01F 17/0013* (2013.01); *H01F 27/245* (2013.01);

(Continued)

(58) Field of Classification Search

CPC ..... H01F 5/00; H01F 27/28

(Continued)

(56) References Cited

U.S. PATENT DOCUMENTS 7,091,816 B1 * 8/2006 Ito ..... H01F 17/0013 336/200
2002/0067235 A1 * 6/2002 Ueda ..... H01F 17/0006 336/200

(Continued)

FOREIGN PATENT DOCUMENTS

JP 04-123405 A 4/1992
JP H05-029119 U 4/1993

(Continued)

OTHER PUBLICATIONS

International Search Report—PCT/JP2014/072242 dated Nov. 25, 2014.
Written Opinion—PCT/JP2014/072242 dated Nov. 25, 2014.

*Primary Examiner* — Tsz Chan
(74) *Attorney, Agent, or Firm* — Studebaker & Brackett PC

(57) ABSTRACT

An electronic component includes a main body formed from an insulative material, coil conductors, outer electrodes provided on a surface of the main body, and outer pads. Each coil conductor is constituted by a spiral-shaped coil portion and a lead portion connected to the coil portion and extending linearly. The outer pads connect the lead portions to the outer electrodes. At a contact point that connects one of the coil portions to their corresponding one of the lead portions, an angle formed by the coil portion and the lead portion is an obtuse angle.

6 Claims, 10 Drawing Sheets

(52) U.S. Cl.
CPC ..... *H01F 27/29* (2013.01); *H01F 2017/0073* (2013.01); *H01F 2017/0093* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2003/0052766 | A1* | 3/2003 | Tomohiro | H01F 17/0013 336/200 |
| 2003/0134612 | A1* | 7/2003 | Nakayama | H01F 17/0013 455/307 |
| 2009/0115562 | A1* | 5/2009 | Lee | H01F 17/0006 336/200 |
| 2009/0153282 | A1* | 6/2009 | Taoka | H01F 17/0013 336/200 |
| 2014/0139307 | A1 | 5/2014 | Kido et al. | |
| 2016/0094082 | A1* | 3/2016 | Ookawa | H01F 38/14 320/108 |

FOREIGN PATENT DOCUMENTS

| | | | |
|---|---|---|---|
| JP | H06-069038 | A | 3/1994 |
| JP | 2002-008922 | A | 1/2002 |
| JP | 2010-080550 | A | 4/2010 |
| WO | 2013/031880 | A1 | 3/2013 |

* cited by examiner

ELECTRONIC COMPONENT AND COMMON MODE CHOKE COIL

CROSS REFERENCE TO RELATED APPLICATIONS

This application claims benefit of priority to Japanese Patent Application 2013-181013 filed Sep. 2, 2013, and to International Patent Application No. PCT/JP2014/072242 filed Aug. 26, 2014, the entire content of which is incorporated herein by reference.

TECHNICAL FIELD

The present disclosure relates to electronic components and common mode choke coils, and particularly relates to an electronic component and a common mode choke coil that include coil conductors.

BACKGROUND

The common mode choke coil disclosed in Japanese Unexamined Patent Application Publication No. 2010-80550, for example, is known as an electronic component that includes a coil conductor. The common mode choke coil disclosed in Japanese Unexamined Patent Application Publication No. 2010-80550 will be described hereinafter.

The common mode choke coil disclosed in Japanese Unexamined Patent Application Publication No. 2010-80550 includes a multilayer body that contains two spiral-shaped coils and is formed by laminating a plurality of insulation layers together, and a plurality of terminal electrodes connected to the two coils. The inner sides of the coils are filled with a magnetic material.

As illustrated in FIG. 10, a coil 513, which is one of the stated two coils, has a coil conductor part 513*c*1 and a lead portion 513*a* that connects the coil conductor part 513*c*1 to the stated terminal electrode. The coil conductor part 513*c*1 advances in a spiral pattern, counter-clockwise from the center thereof toward the outside, and then bends back so as to connect to the lead portion 513*a*.

Here, because the coil conductor part 513*c*1 is connected to the lead portion 513*a* by being bent back, current 1501 that has traveled along the coil conductor part 513*c*1 will begin traveling in the reverse direction at a bend-back portion R. When this happens in the coil conductor part 513*c*1, a magnetic flux produced by the portion before the bend-back portion R and a magnetic flux produced by a portion after the bend-back portion R will face opposite directions. Accordingly, the magnetic fluxes produced by the coil conductor part 513*c*1 will partially cancel each other out. It is therefore difficult to achieve a desired inductance value with the coil conductor part 513*c*1.

SUMMARY

Technical Problem

It is an object of the present disclosure to provide an electronic component and a common mode choke coil capable of suppressing a drop in an inductance value caused by magnetic fluxes produced by coil conductors partially canceling each other out.

Solution to Problem

An electronic component according to a first aspect of the present disclosure includes a main body formed from an insulative material; a plurality of coil conductors provided in the main body, each coil conductor constituted by a spiral-shaped coil portion and a lead portion connected to the coil portion and extending linearly; a plurality of outer electrodes provided on a surface of the main body; and a plurality of outer pads that connect the lead portions to corresponding outer electrodes. Here, at a contact point that connects one of the coil portions to their corresponding one of the lead portions, an angle formed by the coil portion and the lead portion is greater than 180 degrees.

A common mode choke coil according to a second aspect of the present disclosure includes a main body formed from an insulative material; a plurality of coil conductors provided in the main body, each coil conductor constituted by a spiral-shaped coil portion and a lead portion connected to the coil portion and extending linearly; a plurality of outer electrodes provided on a surface of the main body; and a plurality of outer pads that connect the lead portions to corresponding outer electrodes. Here, at a contact point that connects one of the coil portions to their corresponding one of the lead portion, an angle formed by the coil portion and the lead portion is a greater than 180 degrees.

According to the electronic component and the common mode choke coil, at a contact point that connects one of the coil portions to their corresponding one of lead portions, an angle formed by the coil portion and the lead portion is greater than 180 degrees. As a result, current traveling along the coil portion does not end up traveling in the direction opposite from the winding direction of the coil portion at the lead portion. Accordingly, a magnetic flux produced by the coil portion and a magnetic flux produced by the lead portion do not face in opposite directions, and thus the magnetic flux produced by the coil portion and the magnetic flux produced by the lead portion do not cancel each other out. As a result, according to the electronic component and the common mode choke coil, a drop in an inductance value of the coil conductors can be suppressed.

Advantageous Effects of Disclosure

According to the present disclosure, a drop in an inductance value caused by the magnetic fluxes produced by the coil conductors partially canceling each other out can be suppressed.

Figure 1:
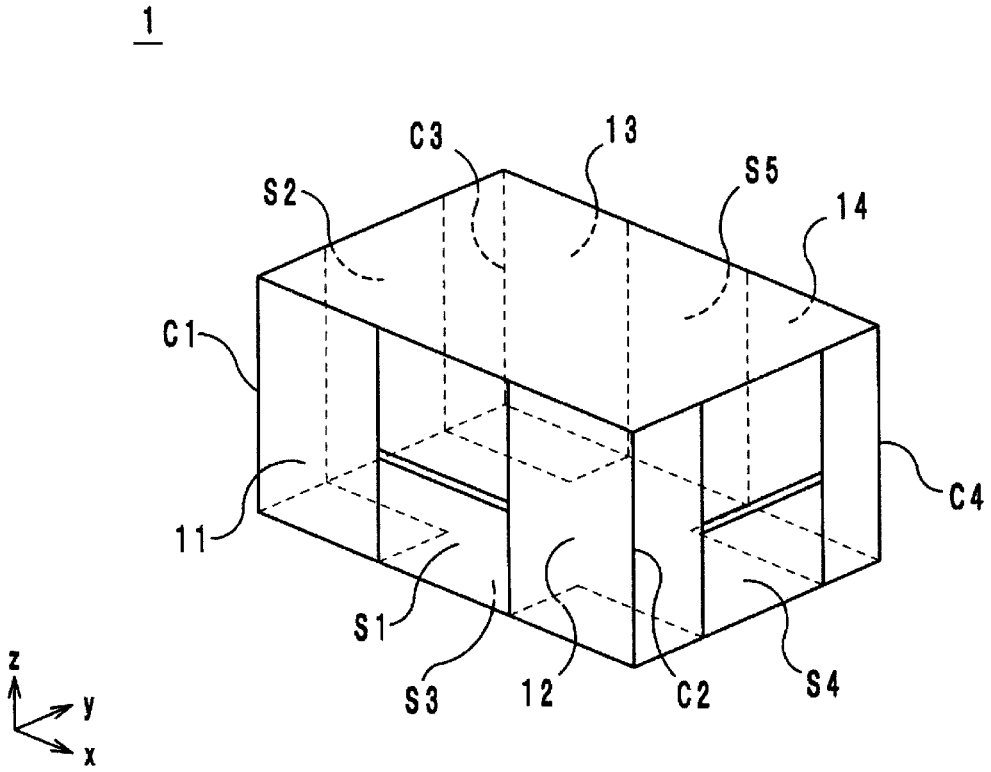
FIG. 1 is an external perspective view illustrating an electronic component according to an embodiment.
Figure 2:
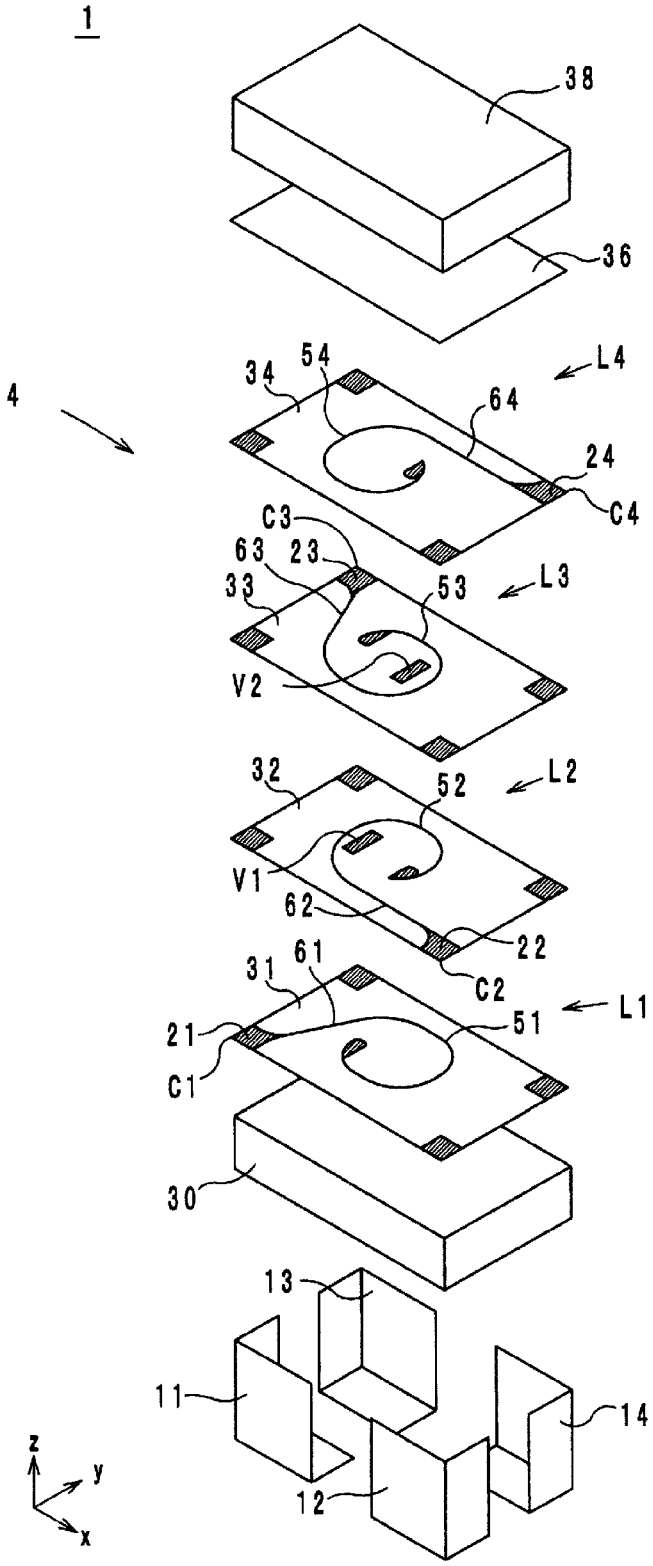
FIG. 2 is an exploded perspective view illustrating an electronic component according to an embodiment.

DETAILED DESCRIPTION (Overall Configuration of Electronic Component, FIGS. 1 and 2)

An electronic component 1 according to an embodiment will be described hereinafter with reference to the drawings. In the following, a lamination direction of the electronic component 1 is defined as a z-axis direction, and directions that follow the sides of the electronic component 1 when viewed in plan view from the z-axis direction are defined as an x-axis direction and a y-axis direction, respectively. Note that the x axis, the y axis, and the z axis are orthogonal to one another.

As illustrated in FIG. 1, the electronic component 1 has a rectangular parallelepiped shape. Meanwhile, as illustrated in FIG. 2, the electronic component 1 includes a main body 4, coil conductors L1 to L4, outer electrodes 11 to 14, outer pads 21 to 24, and via conductors V1 and V2.

(Configuration of Main Body, FIG. 2)

The main body 4 has a rectangular parallelepiped shape, and as illustrated in FIG. 2, is constituted of a magnetic substrate 30, insulation layers 31 to 34, an organic adhesive layer 36, and a magnetic substrate 38 being laminated in that order from a negative side of the z-axis direction. The magnetic substrates 30 and 38, the insulation layers 31 to 34, and the adhesive layer 36 all have rectangular shapes that take the x-axis direction as a lengthwise direction when viewed from the z-axis direction.

The magnetic substrates 30 and 38 are rectangular parallelepiped substrates cut from a fired ferrite ceramic material. Note that the magnetic substrates 30 and 38 may be formed by spreading a paste constituted of a ferrite calcinated powder and a binder on a ceramic substrate such as alumina, or may be formed by laminating and firing green sheets formed from a ferrite material.

The insulation layers 31 to 34 are formed from polyimide. Note that the insulation layers 31 to 34 may be formed from an insulative resin such as benzocyclobutene or the like, or may be formed from an insulative inorganic material such as a glass ceramic material. In the following, a surface on the positive side of the z-axis direction of the insulation layers 31 to 34 will be called an upper surface.

(Configuration of Outer Electrodes, FIG. 1)

The outer electrodes 11 to 14 are formed from a conductive material such as Au, Ag, Cu, Pd, Ni, or the like, and function as input electrodes or output electrodes of the electronic component 1.

As illustrated in FIG. 1, the outer electrode 11 is provided on a surface S1 that is on the negative side of the main body 4 in the y-axis direction and a surface S2 that is on the negative side of the main body 4 in the x-axis direction so as to cover a corner C1, formed by the surfaces S1 and S2, and cover the vicinity of the corner C1. The outer electrode 11 is also provided on a surface S3, which is on the negative side of the main body 4 in the z-axis direction, in the vicinity of the corner C1. Furthermore, the outer electrode 11 is used as an input electrode.

The outer electrode 12 is provided on the surface S1 and a surface S4 that is on the positive side of the main body 4 in the x-axis direction so as to cover a corner C2, formed by the surfaces S1 and S4, and cover the vicinity of the corner C2. The outer electrode 12 is also provided on the surface S3, in the vicinity of the corner C2. Furthermore, the outer electrode 12 is used as an input electrode.

The outer electrode 13 is provided on the surface S2 and a surface S5 that is on the positive side of the main body 4 in the y-axis direction so as to cover a corner C3, formed by the surfaces S2 and S5, and cover the vicinity of the corner C3. The outer electrode 13 is also provided on the surface S3, in the vicinity of the corner C3. Furthermore, the outer electrode 13 is used as an output electrode.

The outer electrode 14 is provided on the surfaces S4 and S5 so as to cover a corner C4 formed by the surfaces S4 and S5 and the vicinity of the corner C4. The outer electrode 14 is also provided in the vicinity of the corner C4 on the surface S3. Furthermore, the outer electrode 14 is used as an output electrode.

(Configuration of Outer Pads, FIG. 2)

The outer pads 21 to 24 are formed from a conductive material such as Au, Ag, Cu, Pd, Ni, or the like, and serve to connect the outer electrodes 11 to 14 provided on the surfaces of the main body 4 to the coil conductors L1 to L4 provided within the main body 4.

As illustrated in FIG. 2, the outer pad 21 extends in the z-axis direction from an upper surface of the insulation layer 31 to the insulation layers 32 to 34, and is provided at the corner C1 and in the vicinity thereof. A surface of the outer pad 21 on the negative side in the x-axis direction and a surface of the outer pad 21 on the negative side in the y-axis direction are exposed on the surfaces S1 and S2, respectively, of the main body 4, and are connected to the outer electrode 11.

The outer pad 22 extends in the z-axis direction from the upper surface of the insulation layer 31 to the insulation layers 32 to 34, and is provided at the corner C2 and in the vicinity thereof. A surface of the outer pad 22 on the positive side in the x-axis direction and a surface of the outer pad 22 on the negative side in the y-axis direction are exposed on the surfaces S1 and S4, respectively, of the main body 4, and are connected to the outer electrode 12.

The outer pad 23 extends in the z-axis direction from the upper surface of the insulation layer 31 to the insulation layers 32 to 34, and is provided at the corner C3 and in the vicinity thereof. A surface of the outer pad 23 on the negative side in the x-axis direction and a surface of the outer pad 23 on the positive side in the y-axis direction are exposed on the surfaces S2 and S5, respectively, of the main body 4, and are connected to the outer electrode 13.

The outer pad 24 extends in the z-axis direction from the upper surface of the insulation layer 31 to the insulation layers 32 to 34, and is provided at the corner C4 and in the vicinity thereof. A surface of the outer pad 24 on the positive side in the x-axis direction and a surface of the outer pad 24 on the positive side in the y-axis direction are exposed on the surfaces S4 and S5, respectively, of the main body 4, and are connected to the outer electrode 14.

(Configuration of Coil Conductors and Connections by Via Conductors, FIGS. 2-6)

The coil conductors L1 to L4 are line-shaped conductors, provided in the main body 4, formed from a conductive material such as Au, Ag, Cu, Pd, Ni, or the like. A coil formed by the coil conductors L1 and L2 and a coil formed by the coil conductors L3 and L4 constitute a common mode choke coil by electromagnetically coupling with each other.

As illustrated in FIG. 2, the coil conductor L1 has a coil portion 51 and a lead portion 61, and is provided on the upper surface of the insulation layer 31. The coil portion 51 forms a spiral shape that, when viewed in plan view from the positive side in the z-axis direction, approaches the center while winding in the clockwise direction.

Figure 3:
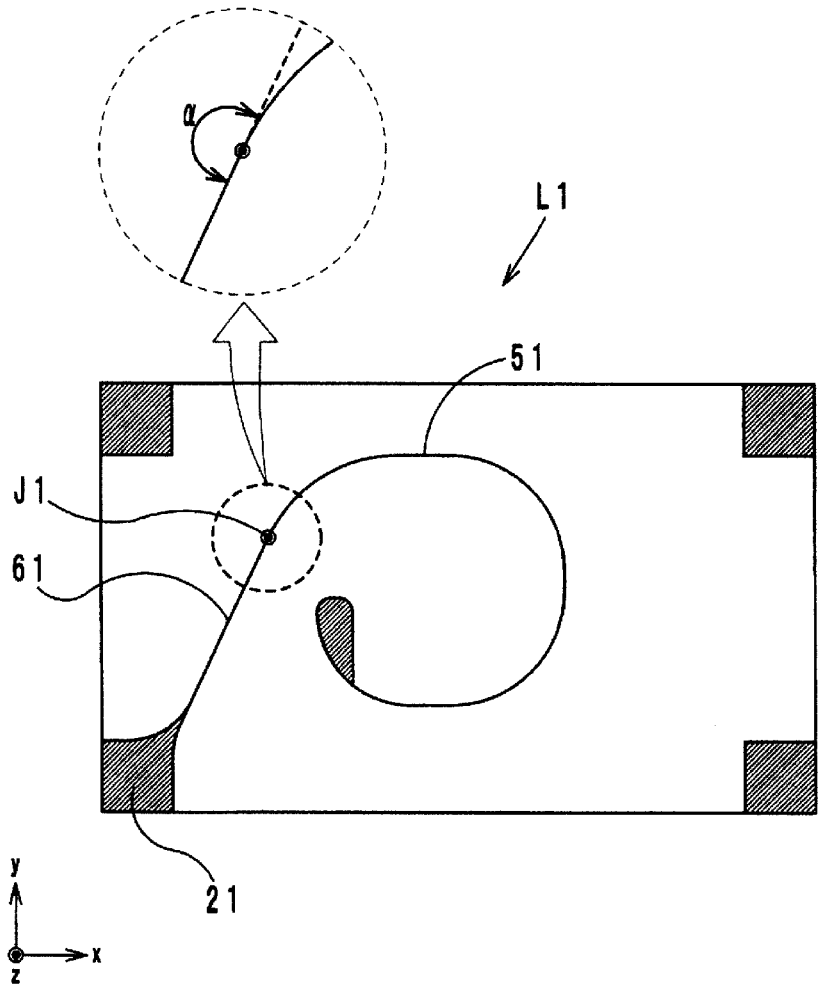
FIG. 3 is a diagram illustrating a coil conductor in an electronic component according to an embodiment, viewed in plan view from a lamination direction.

As illustrated in FIG. 3, the lead portion 61 linearly connects a contact point J1, which is one end of the coil portion 51 on an outer side portion thereof, to the outer pad 21. The coil portion 51 and the lead portion 61 are connected without a bend at the contact point J1. Accordingly, at the contact point J1, a transition between the lead portion 61 and the coil portion 51 is continuous on a convex side thereof facing away from a center of the coil portion 51, and an angle $\alpha$ formed on the convex side by the coil portion 15 and the lead portion 61 is greater than 180°. Furthermore, a width of the the lead portion 61 gradually increases as the lead portion 61 progresses from the contact point J1 to the outer pad 21. Note that the location of the contact point J1 is a point where a straight line drawn from the outer pad 21 to an outer diameter of the portion of the coil conductor L1 that forms the spiral intersects with the outer diameter of the portion of the coil conductor L1 that forms the spiral. The same applies to the locations of contact points J2 to J4, which will be described below.

As illustrated in FIG. 2, the coil conductor L2 has a coil portion 52 and a lead portion 62, and is provided on an upper surface of the insulation layer 32. The coil portion 52 forms a spiral shape that, when viewed in plan view from the positive side in the z-axis direction, approaches the center while winding in the clockwise direction.

Figure 4:
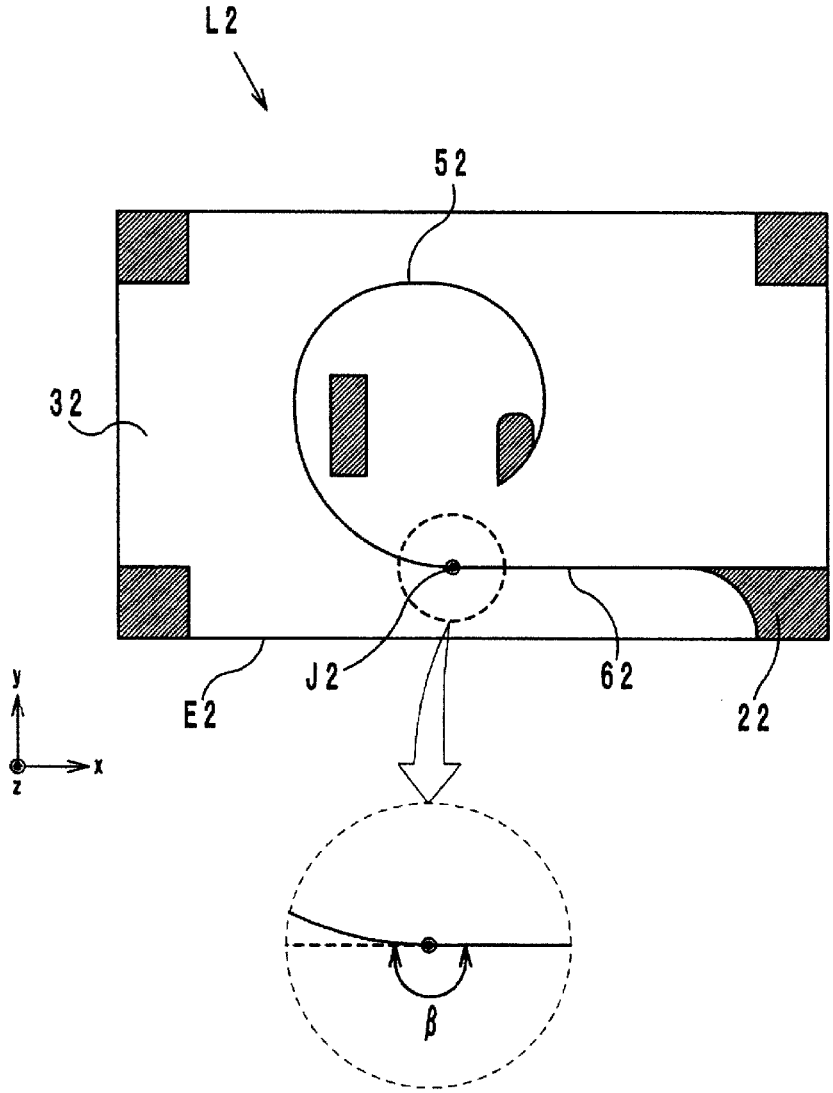
FIG. 4 is a diagram illustrating a coil conductor in an electronic component according to an embodiment, viewed in plan view from a lamination direction.

As illustrated in FIG. 4, the lead portion 62 linearly connects the contact point J2, which is one end of the coil portion 52 on the outer side portion thereof, to the outer pad 22, and is provided parallel to a side E2 that forms an outer edge of the insulation layer 32 in the y-axis direction. The coil portion 52 and the lead portion 62 are connected without a bend at the contact point J2. Accordingly, at the contact point J2, a transition between the lead portion 62 and the coil portion 52 is continuous on a convex side thereof facing away from a center of the coil portion 52, and an angle $\beta$ formed on the convex side by the coil portion 52 and the lead portion 62 is greater than 180°. Furthermore, a width of the lead portion 62 gradually increases as the lead portion 62 progresses from the contact point J2 to the outer pad 22.

As illustrated in FIG. 2, the coil conductor L3 has a coil portion 53 and a lead portion 63, and is provided on an upper surface of the insulation layer 33. The coil portion 53 has a spiral shape that, when viewed in plan view from the positive side in the z-axis direction, progresses toward an outer side portion from the center while winding in the clockwise direction.

Figure 5:
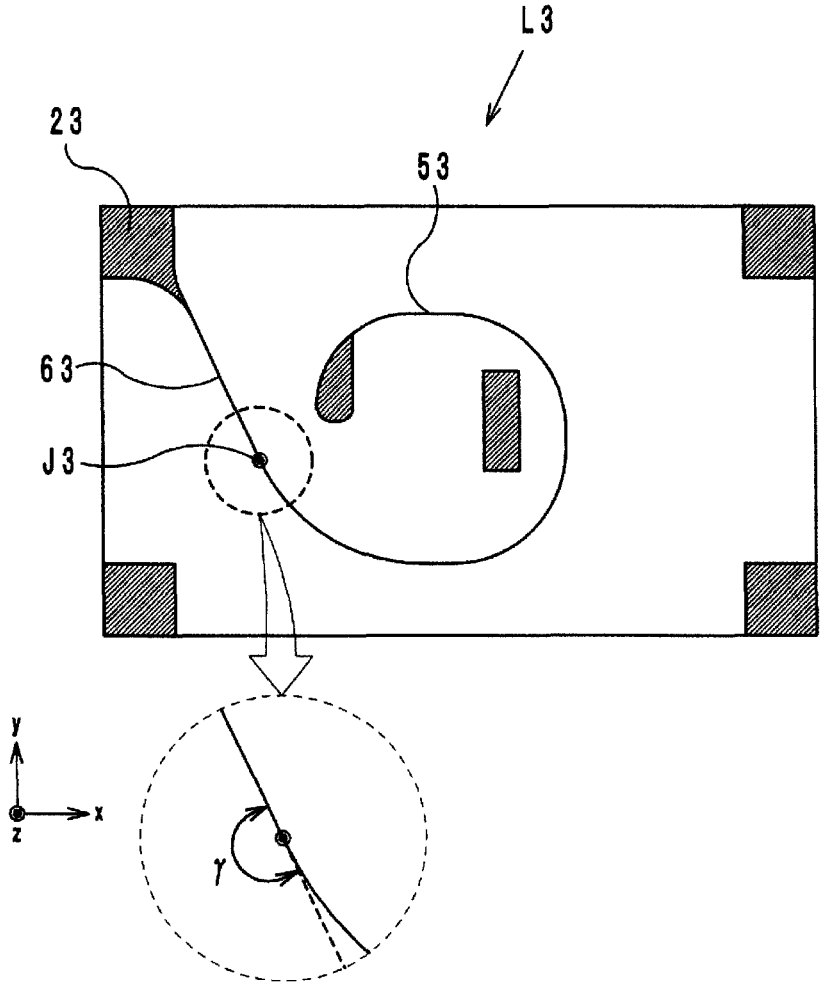
FIG. 5 is a diagram illustrating a coil conductor in an electronic component according to an embodiment, viewed in plan view from a lamination direction.

As illustrated in FIG. 5, the lead portion 63 linearly connects the contact point J3, which is one end of the coil portion 53 on an outer side portion thereof, to the outer pad 23. The coil portion 53 and the lead portion 63 are connected without a bend at the contact point J3. Accordingly, at the contact point J3, a trasition between the lead portion 63 and the coil portion 53 is continusous on a convex side thereof facing away from a center of the coil portion 53, and an angle $\gamma$ formed on the convex side by the coil portion 53 and the lead portion 63 is 180°. Furthermore, a width of the lead portion 63 gradually increases as the lead portion 63 progresses from the contact point J3 to the outer pad 23. As illustrated in FIG. 2, another end of the coil portion 53, located toward the center thereof, is connected to another end of the coil portion 51 of the coil conductor L1, located toward the center thereof, by the via conductor V1, which extends the insulation layers 32 and 33 in the z-axis direction. As a result, the coil conductors L1 and L3 and the via conductor V1 form a single coil.

As illustrated in FIG. 2, the coil conductor L4 has a coil portion 54 and a lead portion 64, and is provided on an upper surface of the insulation layer 34. The coil portion 54 has a spiral shape that, when viewed in plan view from the positive side in the z-axis direction, progresses toward an outer side portion from the center while winding in the clockwise direction.

Figure 6:
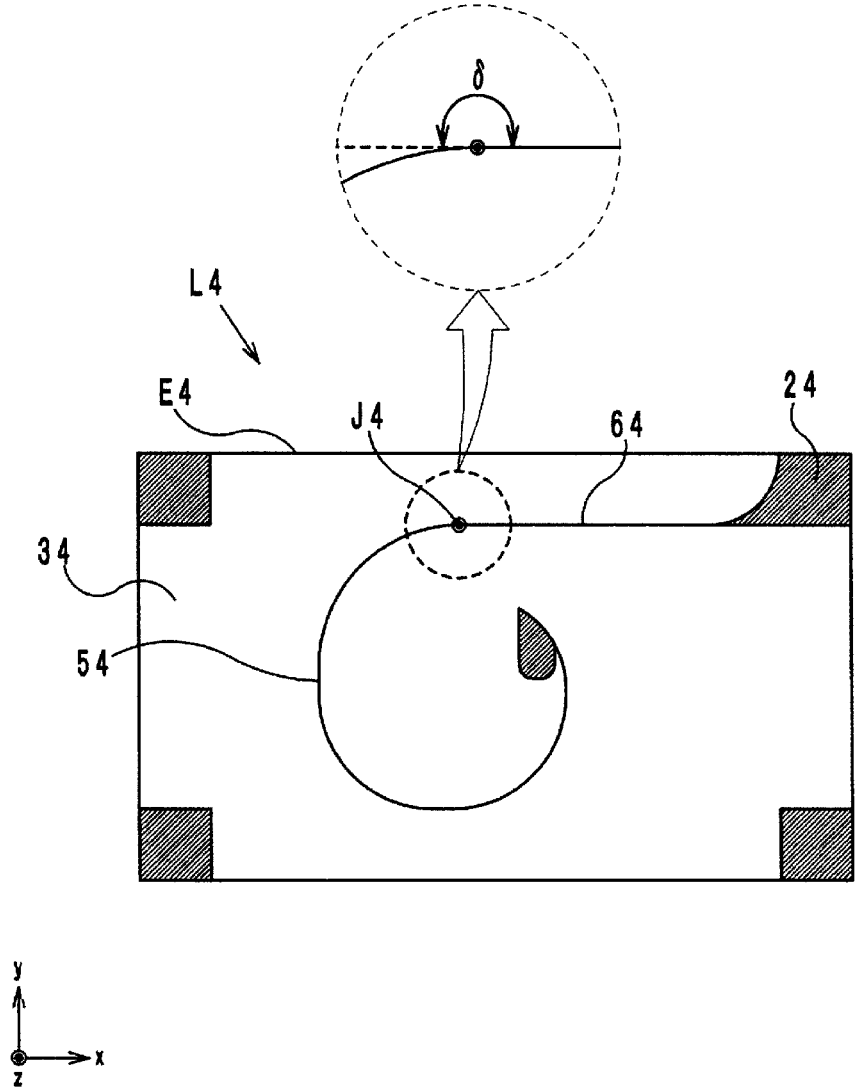
FIG. 6 is a diagram illustrating a coil conductor in an electronic component according to an embodiment, viewed in plan view from a lamination direction.

As illustrated in FIG. 6, the lead portion 64 linearly connects the contact point J4, which is one end of the coil portion 54 on an outer side portion thereof, to the outer pad 24, and is provided parallel to a side E4 that forms an outer edge of the insulation layer 34 in the y-axis direction. The coil portion 54 and the lead portion 64 are connected without a bend at the contact point J4. Accordingly, at the contact point J4, a transition between the lead portion 64 and the coil portion 54 is continuous on a convex side thereof facing away from a center of the coil portion 54, and an angle $\delta$ formed on the convex side by the coil portion 54 and the lead portion 64 is greater than 180°. Furthermore, a width of the lead portion 64 gradually increases as the lead portion 64 progresses from the contact point J4 to the outer pad 24. As illustrated in FIG. 2, another end of the coil portion 54, located toward the center thereof, is connected to another end of the coil portion 52 of the coil conductor L2, located toward the center thereof, by the via conductor V2, which extends the insulation layers 33 and 34 in the z-axis direction. As a result, the coil conductors L2 and L4 and the via conductor V2 form a single coil.

(Function of Electronic Component)

When the electronic component 1 configured as described above is viewed in plan view from the z-axis direction, the coil conductors L1 to L4 overlap. Accordingly, a magnetic flux produced by current flowing in the coil conductors L1 and L3 from the outer electrode 11 passes through the coil conductors L2 and L4, and a magnetic flux produced by current flowing in the coil conductors L2 and L4 from the outer electrode 12 passes through the coil conductors L1 and L3. As such, the coil formed by the coil conductors L1 and L3 and the coil formed by the coil conductors L2 and L4 magnetically couple with each other and form a common mode choke coil. Meanwhile, the outer electrodes 11 and 12 are used as input terminals and the outer electrodes 13 and 14 are used as output terminals. In other words, a differential transmission signal is inputted from the outer electrodes 11 and 12 and outputted from the outer electrodes 13 and 14. At this time, in the case where the differential transmission signal contains common mode noise, the coil conductors L1 to L4 produce magnetic fluxes in the same direction due to the common mode noise current. As a result, the magnetic fluxes strengthen each other, and impedance is produced in response to the common mode noise current. As a result, the common mode noise current is converted into heat, and is suppressed from passing through the coil conductors L1 to L4. On the other hand, in the case where normal mode current is flowing, the magnetic flux produced in the coil formed by the coil conductors L1 and L3 and the magnetic flux produced in the coil formed by the coil conductors L2 and L4 travel in opposite directions. The magnetic fluxes cancel each other out as a result, and thus no impedance is produced in response to the normal mode current. Accordingly, the normal mode current can pass through the coil conductors L1 to L4.

(Effects)

According to the electronic component 1, a drop in an inductance value caused by the magnetic fluxes produced by the coil conductors partially canceling each other out can be suppressed. Specifically, as illustrated in FIGS. 3 to 6, the respective angles formed by the coil portions 51 to 54 and the lead portions 61 to 64 at the contact points J1 to J4 where the coil portions 51 to 54 and the lead portions 61 to 64 are connected are greater than 180 degrees. As such, all current traveling along the coil portions 51 to 54 do not end up traveling in the direction opposite from the winding direction of the coil portions 51 to 54 at the lead portions 61 to 64. Accordingly, a magnetic flux produced by the coil portions 51 to 54 and a magnetic flux produced by the lead portions 61 to 64 do not face in opposite directions, and thus the magnetic flux produced by the coil portions and the magnetic flux produced by the lead portions do not cancel each other out. As a result, according to the electronic component 1, a drop in an inductance value of the coil conductors L1 to L4 can be suppressed.

Meanwhile, the lead portion 62 is provided parallel to the side E2 that forms the outer edge of the insulation layer 32 in the y-axis direction. Accordingly, the coil diameter of the coil portion 52 can be expanded and providing the lead portion 62 so that the direction in which the lead portion 62 extends approaches the winding direction of the coil portion 52 makes it easier for the lead portion 62 to function as a coil than if the lead portion 62 is provided, for example, diagonal to the side E2 from the vicinity of the center of the coil portion 52 toward the outer pad 22. The lead portion 64 is also provided parallel to the side E4 that forms the outer edge of the insulation layer 34 in the y-axis direction, which can expand the coil diameter of the coil portion 54 and makes it easier for the lead portion 64 to function as a coil than if the lead portion 64 is provided diagonal to the side E4 from the vicinity of the center of the coil portion 54 toward the outer pad 24.

Furthermore, according to the electronic component 1, the outer electrodes 11 and 12 used as input electrodes are provided on the surfaces S1 to S4, as illustrated in FIG. 1. In other words, according to the electronic component 1, the two input electrodes are respectively provided on the surface S1 (a first side surface) mainly, which is a side surface of the main body 4 on the negative side thereof in the y-axis direction. Meanwhile, the outer electrodes 13 and 14 used as the output electrodes are provided on the surfaces S2 to S5. In other words, according to the electronic component 1, the two output electrodes are respectively provided on the surface S5 (a second side surface) mainly, which is a side surface of the main body 4 on the positive side thereof in the y-axis direction. Thus according to the electronic component 1, the input electrodes and the output electrodes are arranged on either the positive or negative side of the main body 4 in the y-axis direction, and thus the electronic component 1 is easy to handle when mounting the component on a circuit board.

Figure 7:
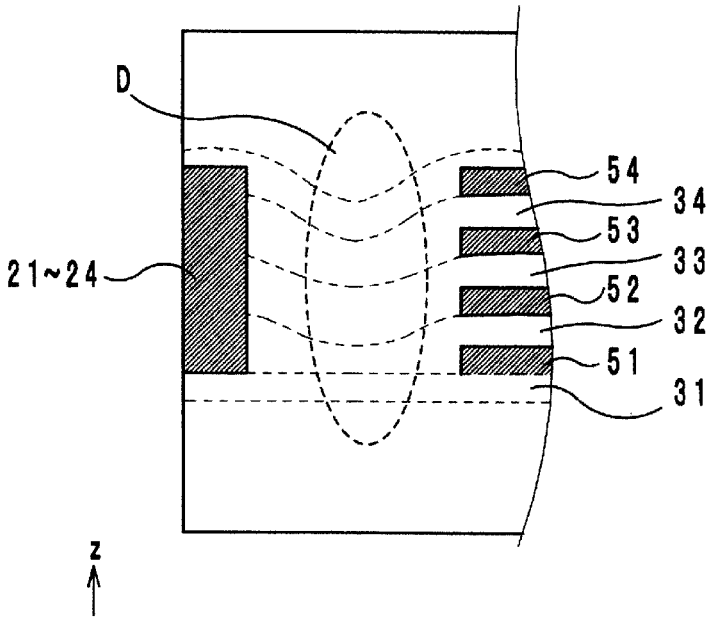
FIG. 7 is a cross-sectional view taken from a direction orthogonal to a lamination direction of an electronic component according to an embodiment.

Incidentally, the electronic component 1 can prevent the coil conductors from breaking. Specifically, as illustrated in FIG. 7, a portion of the electronic component 1 containing the coil portions 51 to 54 and a portion of the electronic component 1 containing the outer pads 21 to 24 are thicker in the z-axis direction than other portions by an amount equivalent to the thicknesses of the coil portions 51 to 54 and the outer pads 21 to 24. As a result, an indented portion D that is relatively thinner is formed in an area between the coil portion and the outer pad on the same insulation layer. Accordingly, the lead portions 61 to 64 deform when transecting the indented portion D, which makes the lead portions 61 to 64 easy to break. However, according to the electronic component 1, the widths gradually increase from the contact points J1 to J4 toward the outer pads 21 to 24, as illustrated in FIGS. 3 to 6. As such, the widths of the lead portions 61 to 64 increase when transecting the indented portion D, which makes it possible to suppress the lead portions 61 to 64 from breaking due to deformation.

Figure 8:
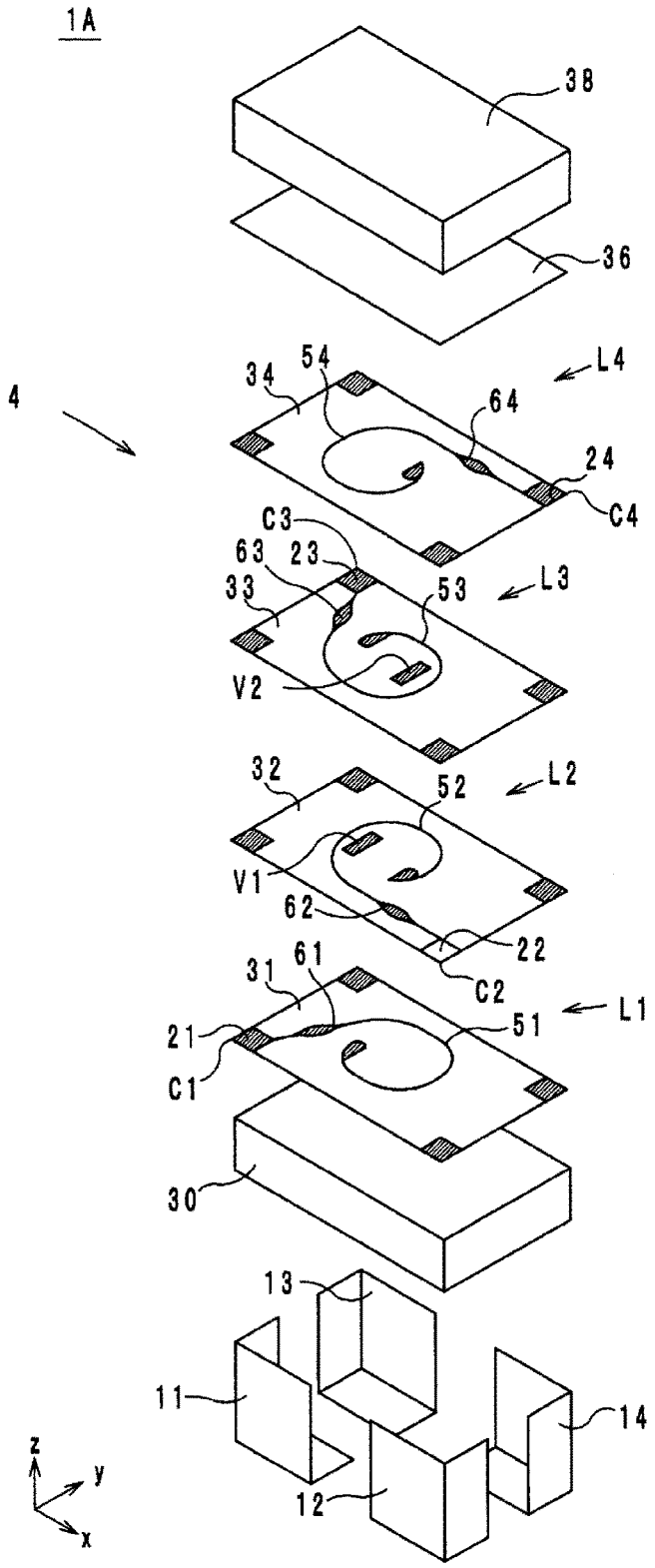
FIG. 8 is an exploded perspective view illustrating an electronic component according to a variation.

(First Variation, FIGS. 7 and 8)

An electronic component 1A according to a first variation differs from the electronic component 1 in that the widths of the lead portions 61 to 64 are greater in the approximate center areas between the coil portions 51 to 54 and the outer pads 21 to 24, respectively, than in the other areas, as illustrated in FIG. 8. As such, according to the electronic component 1A, the coil conductors can be more effectively prevented from breaking than in the electronic component 1.

As illustrated in FIG. 7, a portion of the electronic component 1A containing the coil portions 51 to 54 and a portion of the electronic component 1A containing the outer pads 21 to 24 are thicker in the z-axis direction than other portions by an amount equivalent to the thicknesses of the coil portions 51 to 54 and the outer pads 21 to 24. As a result, an indented portion D that is relatively thinner is formed in an area between the coil portion and the outer pad on the same insulation layer. The indented amount of this portion is greatest in the approximate center areas between the coil portions 51 to 54 and the outer pads 21 to 24, respectively. In other words, the lead portions 61 to 64 experience the largest deformation in the approximate center areas between the coil portions 51 to 54 and the outer pads 21 to 24, respectively, making those areas susceptible to breakage. As such, according to the electronic component 1A, increasing the widths of the lead portions 61 to 64 in the approximate center areas between the coil portions 51 to 54 and the outer pads 21 to 24, respectively, makes it possible to more effectively suppress breakage due to deformation.

Note that the rest of the configuration of the electronic component 1A is the same as the electronic component 1. Accordingly, descriptions of the electronic component 1A aside from the lead portions 61 to 64 are the same as for the electronic component 1.

Figure 9:
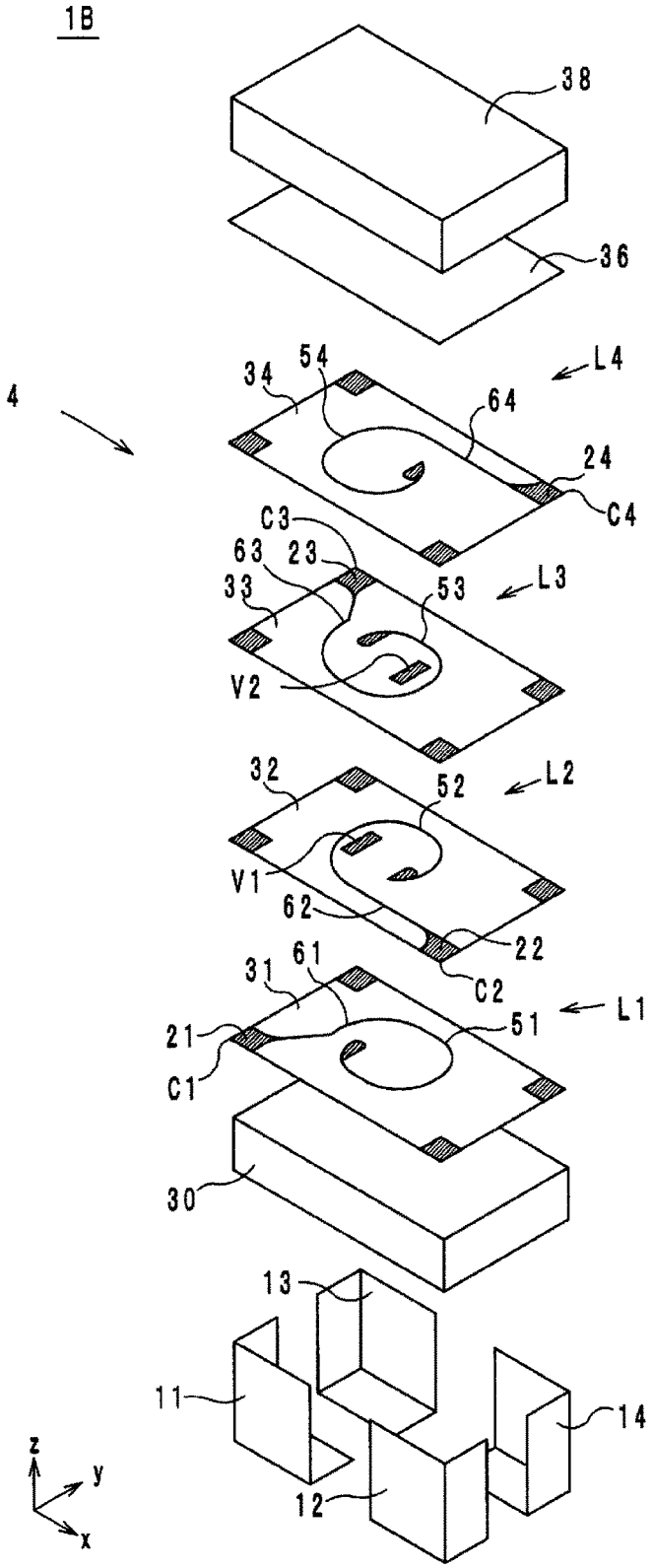
FIG. 9 is an exploded perspective view illustrating an electronic component according to a variation.
Figure 10:
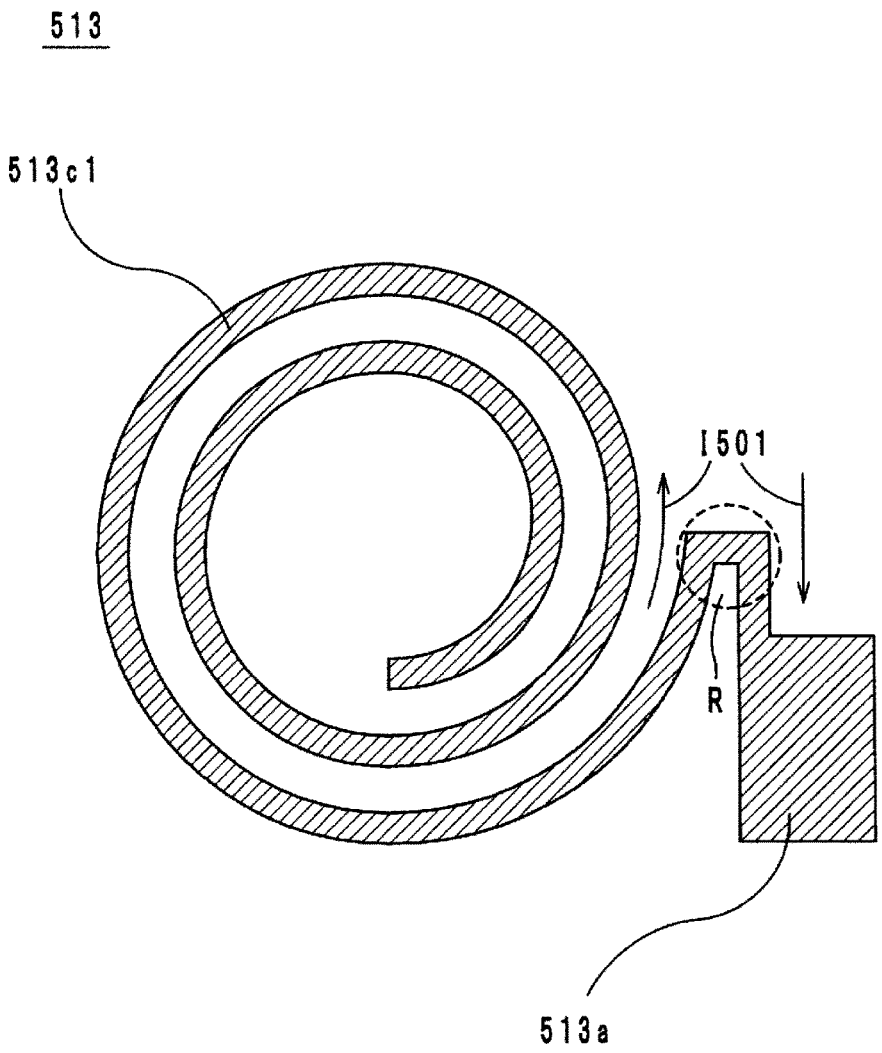
FIG. 10 PRIOR ART
FIG. 10 is a diagram illustrating a coil conductor part and a lead portion of a common mode choke coil disclosed in Japanese Unexamined Patent Application Publication No. 2010-80550, viewed in plan view from a lamination direction.

(Second Variation, FIG. 9)

An electronic component 1B according to a second variation differs from the electronic component 1 in that the coil conductor L1 bends at the contact point J1 between the coil portion 51 and the lead portion 61 and the coil conductor L3 bends at the contact point J3 between the coil portion 53 and the lead portion 63, as illustrated in FIG. 9. Even if the coil conductor L1 and the coil conductor L3 have the stated configuration, the angle formed by the coil portion 51 and the lead portion 61 and the angle formed by the coil portion 53 and the lead portion 63 are greater than 80 degree, and thus the same effects as the electronic component 1 can be achieved.

Note that the rest of the configuration of the electronic component 1B is the same as the electronic component 1. Accordingly, descriptions of the electronic component 1B aside from the coils L1 and L3 are the same as for the electronic component 1.

(Other Embodiments)

The electronic component and common mode choke coil according to the present disclosure are not intended to be limited to the aforementioned embodiments, and many variations can be made thereon without departing from the essential scope of the present disclosure. For example, the number of input electrodes and output electrodes of the electronic component may be set to one each and the coil conductors L1 to L4 may be connected in order so as to use the electronic component as an inductor.

INDUSTRIAL APPLICABILITY

As described above, the present disclosure is useful in electronic components and common mode choke coils, and is particularly advantageous in suppressing a drop in an inductance value caused by magnetic fluxes produced by coil conductors partially canceling each other out.

The invention claimed is:

1. An electronic component comprising:

a main body formed from an insulative material;

a plurality of coil conductors provided in the main body, each coil conductor constituted by a spiral-shaped coil portion and a lead portion connected to the coil portion and extending linearly;

a plurality of outer electrodes provided on a surface of the main body; and a plurality of outer pads that connect the lead portions to corresponding outer electrodes, wherein at a contact point that connects one of the coil portions to their corresponding one of the lead portions, a transition between the linear lead portion and the spiral-shaped coil portion is continuous on a convex side thereof facing away from a center of the spiral-shaped coil portion, and an angle formed on the convex side by the spiral-shaped coil portion and the linear lead portion is greater than 180 degrees.

2. The electronic component according to claim 1, wherein the main body includes a plurality of insulation layers laminated together, and has a first side surface and a second side surface extending along the lamination direction and opposite from each other;

each of a plurality of input electrodes included in the plurality of outer electrodes is provided on the first side surface; and each of a plurality of output electrodes included in the plurality of outer electrodes is provided on the second side surface.

3. The electronic component according to claim 1, wherein the insulation layers are rectangular; and one of the lead portions is parallel to any side that forms an outer edge of the insulation layers.

4. The electronic component according to claim 1, wherein a width of one of the lead portions increases as the lead portion progresses from the coil portion toward the outer pad.

5. An electronic component comprising:

a main body formed from an insulative material;

a plurality of coil conductors provided in the main body, each coil conductor constituted by a spiral-shaped coil portion and a lead portion connected to the coil portion and extending linearly;

a plurality of outer electrodes provided on a surface of the main body; and a plurality of outer pads that connect the lead portions to corresponding outer electrodes, wherein at a contact point that connects one of the coil portions to their corresponding one of the lead portions, an angle formed by the coil portion and the lead portion is at least an obtuse angle, wherein a width of one of the linearly extending lead portions is greater in an approximate center area between the coil portion and the outer pad than in areas on either side of the approximate center area.

6. A common mode choke coil comprising:

a main body formed from an insulative material;

a plurality of coil conductors provided in the main body, each coil conductor constituted by a spiral-shaped coil portion and a lead portion connected to the coil portion and extending linearly;

a plurality of outer electrodes provided on a surface of the main body; and a plurality of outer pads that connect the lead portions to corresponding outer electrodes, wherein at a contact point that connects one of the coil portions to their corresponding one of the lead portions, a transition between the linear lead portion and the spiral-shaped coil portion is continuous on a convex side thereof facing away from a center of the spiral-shaped coil portion, and an angle formed on the convex side by the spiral-shaped coil portion and the linear lead portion is greater than 180 degrees.

* * * * *